US012697558B2

(12) United States Patent
Halpert et al.

(10) Patent No.: US 12,697,558 B2
(45) Date of Patent: Aug. 4, 2026

(54) LAUNCHING APPARATUS FOR TOY VEHICLES

(71) Applicant: SPIN MASTER LTD., Toronto (CA)

(72) Inventors: Eli Halpert, Los Angeles, CA (US); David Sheltman, Los Angeles, CA (US); Romina Rodriguez, Los Angeles, CA (US); Liliana Sánchez Bravo, Long Beach, CA (US)

(73) Assignee: SPIN MASTER LTD., Toronto (CA)

( * ) Notice: Subject to any disclaimer, the term of this patent is extended or adjusted under 35 U.S.C. 154(b) by 250 days.

(21) Appl. No.: 18/732,581

(22) Filed: Jun. 3, 2024

(65) Prior Publication Data

US 2025/0367567 A1 Dec. 4, 2025

(51) Int. Cl.
*A63H 17/00* (2006.01)
*A63H 18/02* (2006.01)

(52) U.S. Cl.
CPC ..... *A63H 17/008* (2013.01); *A63H 18/026* (2013.01)

(58) Field of Classification Search
CPC .... A63H 17/008; A63H 18/02; A63H 18/026; A63H 18/028
See application file for complete search history.

(56) References Cited

U.S. PATENT DOCUMENTS 2,756,687 A * 7/1956 Fields ..... A63H 18/04 446/444
3,209,491 A * 10/1965 Roeper ..... A63H 18/028 238/10 R
3,540,153 A * 11/1970 Masaru ..... A63H 18/08 105/29.2
4,016,674 A 4/1977 Resnick et al.
4,203,247 A * 5/1980 Moe ..... A63H 17/008 446/429
4,642,066 A * 2/1987 Kennedy ..... A63H 17/008 446/420
5,102,133 A * 4/1992 Chilton ..... A63H 18/028 238/10 F
6,000,992 A * 12/1999 Lambert ..... A63H 18/026 446/444

(Continued)

FOREIGN PATENT DOCUMENTS

EP 4023315 A1 * 7/2022 ..... A63H 18/08

*Primary Examiner* — Eugene L Kim
*Assistant Examiner* — Alyssa M Hylinski
(74) *Attorney, Agent, or Firm* — Aird & Berlis LLP

(57) ABSTRACT

A launching apparatus for toy vehicles is provided herein. The launching apparatus is structured for sequentially launching a plurality of the toy vehicles, and includes a holding section that supports the plurality of toy vehicles in a sequential line, where at least part of the holding section is formed as an inverted support region that is structured to hold at least some of the plurality of vehicles in an at least partially upside-down orientation. The launching apparatus also includes a launching section that is connected to the holding section; and a release element that movable between a blocking position where the release element retains the plurality of toy vehicles on the holding section, and a launching position where the release element permits a toy vehicle of the plurality of toy vehicles to be released onto the launching section from the holding section, under the influence of gravity.

20 Claims, 11 Drawing Sheets

(56) References Cited

U.S. PATENT DOCUMENTS

| | | | | |
|---|---|---|---|---|
| 6,089,951 | A * | 7/2000 | Ostendorff | A63H 18/005 446/444 |
| 6,358,112 | B1 | 3/2002 | Lambert et al. | |
| 6,676,480 | B2 | 1/2004 | Sheltman | |
| 6,793,554 | B1 | 9/2004 | Newbold | |
| 7,637,796 | B2 | 12/2009 | Hippely | |
| 7,955,158 | B2 | 6/2011 | Filoseta et al. | |
| 8,011,994 | B2 * | 9/2011 | Fink | A63H 18/026 446/168 |
| 8,366,508 | B2 | 2/2013 | Filoseta | |
| 8,870,623 | B2 * | 10/2014 | Ferreyra | A63H 18/16 446/429 |
| 8,944,881 | B2 * | 2/2015 | Payne | A63H 18/028 446/444 |
| 9,573,071 | B2 * | 2/2017 | Yu | A63H 18/028 |
| 9,707,489 | B2 * | 7/2017 | Nuttall | A63H 18/02 |
| 11,426,670 | B2 | 8/2022 | Kenney et al. | |
| 11,426,671 | B2 | 8/2022 | Cao | |
| 11,491,412 | B2 | 11/2022 | Cao | |
| 2020/0330887 | A1 | 10/2020 | Samo et al. | |

* cited by examiner

LAUNCHING APPARATUS FOR TOY VEHICLES

FIELD OF THE DISCLOSURE

The present disclosure relates generally to toy vehicles track sets and accessories for use therewith. In particular, the disclosure relates to a launching apparatus for toy vehicles.

BACKGROUND OF THE DISCLOSURE

Toy vehicle playsets are well known in the art and have enjoyed great popularity for many years. Toy vehicle track sets may include one or more track sections arranged to form a closed loop around which one or more toy vehicles can travel. Common and popular types of toy vehicle playsets include closed loop track sets that define a plurality of curves and loop portions within which one or more toy vehicle boosters are operated, and open loop track sets where a toy launcher is provided to launch toy vehicles onto the open loop track and thereby drive the motion of the vehicles along the track. The toy vehicles used in these closed and open loops may be either self-powered or receive power from an external source. Devices used to accelerate unpowered toy vehicles around a track are often referred to as "launchers" or "boosters".

Probably the simplest form of accelerating the toy vehicles is found in toy launchers which include a launch ramp, where the launch ramp utilizes gravity and a severe slope in the launch ramp to launch the vehicles from a higher position to a lower position. Still other toy vehicle launchers utilize spring-driven launchers often employing a moving ram which is spring-powered, and which fires a toy vehicle from a launch position by impact. Boosters for accelerating toy vehicles typically utilizes one or more rotating wheels which engage the sides or top portions of the toy vehicle entering the booster and, due to their motor-driven rotation, accelerate the toy vehicle through the playset trackway.

To improve the amusement, excitement and appeal of toy vehicle playsets, practitioners of the toy arts have endeavored to provide various stunt apparatus within playsets. Examples of such stunt apparatus include inverting loops, spiral paths, jumps of various kinds as well as obstacles or interfering elements which attach or impede passing toy vehicles. The toy vehicles themselves are generally free wheeling in such booster activated playsets and comprise relatively simple toy vehicle bodies having a plurality of supporting freely rolling wheels.

Despite substantial variation and great effort by practitioners of the toy arts in providing evermore improved and interesting toy vehicle playsets, there remains nonetheless a continuing need in the art for ever more interesting, exciting and innovative toy vehicle playsets. It is therefore an object of the disclosure to provide a novel launching apparatus for toy vehicles.

SUMMARY OF THE DISCLOSURE

According to an aspect, there is provided a launching apparatus for sequentially launching a plurality of toy vehicles, the launching apparatus comprising: a track body that includes: a holding section that is structured to support the plurality of toy vehicles in a sequential line, at least part of the holding section being formed as an inverted support region that is structured to hold at least some of the plurality of vehicles in an at least partially upside-down orientation; and a launching section that is connected to the holding section; and a release element that is movably connected to the track body for moving between a blocking position where the release element retains the plurality of toy vehicles on the holding section, and a launching position where the release element permits at least a first toy vehicle of the plurality of toy vehicles to be released onto the launching section from the holding section; wherein the launching section is oriented relative to the holding section such that at least a first toy vehicle of the plurality of toy vehicles is released from the holding section onto the launching section under the influence of gravity.

According to another aspect, there is provided a toy track set and toy vehicle kit, comprising: a plurality of toy vehicles; and a launching apparatus including a track body that includes an inverted support region that is structured to support the plurality of toy vehicles in an at least partially upside-down orientation; and a launching section that is connected to the inverted support region; a release element that is movable between a blocking position where the release element retains the plurality of toy vehicles on the inverted support region, and a launching position where the release element permits at least a first toy vehicle of the plurality of toy vehicles to be released from the inverted support region onto the launching section; and wherein the launching section is oriented relative to the inverted support region such that the at least a first toy vehicle of the plurality of toy vehicles which is released from the inverted support region travels onto the launching section under the influence of gravity.

According to another aspect, there is provided a launching apparatus for sequentially launching a plurality of toy vehicles, the launching apparatus comprising: a track body that includes a holding section that is structured to support the plurality of toy vehicles in a sequential line, at least part of the holding section being formed as an inverted support region that is structured to hold at least some of the plurality of vehicles in an at least partially upside-down orientation; and a launching section that is connected to the holding section; and a release element that is movably connected to the track body for moving between a blocking position where the release element retains the plurality of toy vehicles on the holding section, and a launching position where the release element permits at least a first toy vehicle of the plurality of toy vehicles to be released onto the launching section from the holding section under the influence of gravity.

According to yet another aspect, there is provided a launching apparatus for sequentially launching a plurality of toy vehicles, the launching apparatus comprising: a track body that includes a holding section that is structured to support the plurality of toy vehicles in a sequential line, at least part of the holding section being formed as an inverted support region that is structured to hold at least some of the plurality of vehicles in an at least partially upside-down, first orientation; and a launching section that is connected to the holding section; and a release element that is movably connected to the track body for moving between a blocking position where the release element retains the plurality of toy vehicles on the holding section, and a launching position where the release element permits at least one toy vehicle of the plurality of toy vehicles to be released onto the launching section from the holding section under the influence of gravity; wherein the launching section is structured such that the at least one toy vehicle is held in a second orientation when the at least one toy vehicle is released onto the launching section; and wherein the second orientation is less upside-down than the at least partially upside-down, first orientation.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
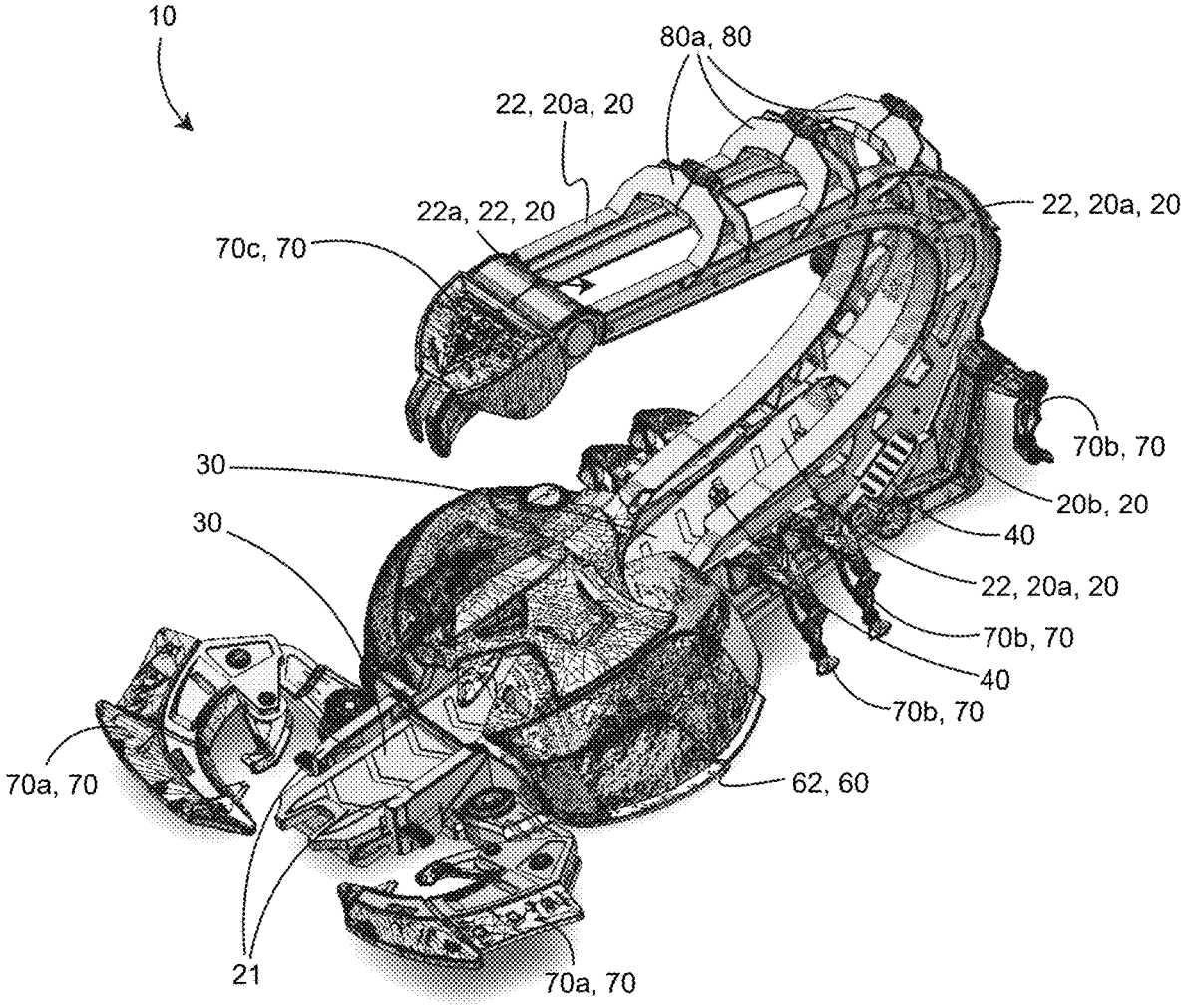
FIG. 1 shows an isometric view of an embodiment of the launching apparatus of the present disclosure.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

As used herein, the terms "comprises" and "comprising" are to be construed as being inclusive and open ended, and not exclusive. Specifically, when used in the specification and claims, the terms "comprises" and "comprising", and variations thereof mean the specified features, steps or components are included. These terms are not to be interpreted to exclude the presence of other features, steps or components.

As used herein, the terms "about" and "approximately" are meant to cover variations that may exist in the upper and lower limits of the ranges of values, such as variations in properties, parameters, and dimensions.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The embodiments described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the disclosure, therefore, is only to be limited by the claims appended hereto and any amendments made thereto.

Referring to FIGS. 1 to 7C of the present disclosure, there is provided an embodiment of a launching apparatus 10 for sequentially launching a plurality of toy vehicles 12. In this embodiment, the launching apparatus 10 comprises a track body 20. The track body 20 includes a holding section 22 that is structured to support the plurality of toy vehicles 12 in a sequential line, and a launching section 30 that is connected to the holding section 22. At least part of the holding section 22 is formed as an inverted support region 22*a* that is structured to hold at least some of the plurality of toy vehicles 12 in an at least partially upside-down orientation. The launching apparatus 10 also includes a release element 40 that is movably connected to the track body 20 for moving between a blocking position (shown in FIGS. 6A and 7) where the release element 40 retains the plurality of toy vehicles 12 on the holding section 22, and a launching position (shown in FIG. 6B) where the release element 40 permits at least one toy vehicle 12 of the plurality of toy vehicles 12 to be released onto the launching section 30 from the holding section 22. The launching section 30 of the track body 20 is oriented relative to the holding section 22 such that the at least one toy vehicle 12 of the plurality of toy vehicles 12 is released from the holding section 22 onto the launching section 30, under the influence of gravity.

Said another way, the release element 40 of the launching apparatus 10 is movably connected to the track body 20 for moving between the blocking position where the release element 40 retains the plurality of toy vehicles 12 on the holding section 22, and the launching position where the release element 40 permits a toy vehicle of the plurality of toy vehicles 12 to be released onto the launching section 30 from the holding section 22 under the influence of gravity.

In an embodiment, the track body 20 of the launching apparatus 10 defines a track segment 20*a* along which the plurality of toy vehicles 12 are supported and travel. The track segment 20*a* can include both the holding section 22 and the launching section 30 of the track body 20. The track body 20 also includes a support base 20*b* upon which the track segment 20*a* is connected. The support base 20*b* rests on a support surface (such as a table or the ground) during use of the launching apparatus 10 and functions to support the track segment 20*a* and other elements of the launching apparatus 10.

In an embodiment such as shown in FIGS. 1 to 7, the launching apparatus 10 is structured to launch the plurality of toy vehicles 12 by accelerating the toy vehicles 12 as the plurality of toy vehicles 12 travel along the launching section 30 of the track body 20. In this way, the plurality of toy vehicles 12 are not solely accelerated by the influence of gravity and can achieve higher speeds when being launched from the launching apparatus 10. In this embodiment, the launching apparatus 10 includes a booster element 60 that is structured to accelerate the at least one toy vehicle 12 released by the release element 40, as the at least one toy vehicle 12 travels along the launching section 30.

In an additional embodiment, the booster element 60 is disposed along a portion of the launching section 30 for accelerating the at least one toy vehicle 12. The booster element 60 is structured to engage the toy vehicle 12 of the plurality of toy vehicles 12 that is released from the holding section 22 (by the release element 40) for accelerating the toy vehicle 12 along the launching section 30.

In the specific embodiment provided in FIGS. 1 to 4 and 6A to 7, the booster element 60 is disposed on either side and atop the track segment 20*a* of the track body 20. The booster element 60 includes a booster housing 62, and a booster mechanism 64 that is contained within the housing. The booster element 60 is disposed along the length of the launching section 30 of the track segment 20*a*. Due to the placement of the booster element 60 along the launching section 30, the launching section 30 of the track segment 20*a* is effectively split into three parts: a first, proximal part 30*a*, a second middle part 30*b*, and a third, distal part 30*c*. The booster housing 62 includes a through-opening extending along the length thereof. A length of the launching section 30 of the track segment 20*a* of the track body 20 extends through the through-opening of the booster housing 62 and thereby defines the second, middle part 30*b* of the launching section 30 on the track segment 20*a*. The booster mechanism 64 is positioned within the booster housing 62 to engage the at least one toy vehicle 12 of the plurality of toy vehicles 12 as the at least one toy vehicle 12 travels along the middle part 30*b* of the launching section 30 of the track segment 20*a*, for accelerating the at least one toy vehicle 12.

In an additional embodiment, the booster element 60 of the launching apparatus 10 is structured such that the booster mechanism 64 is a wheel booster, where the booster mechanism 64 of the booster element 60 includes at least one drive wheel, and a corresponding drive mechanism that is operably connected to the drive wheel to drive a rotational motion thereof. The at least one drive wheel is positioned within the booster housing 62 and is disposed relative to the middle part 30*b* of the launching section 30 so as to engage the at least one toy vehicle 12 as the at least one toy vehicle 12 travels along the launching section 30.

In another, additional embodiment, the booster element 60 is structured such that the at least one drive wheel includes a first drive wheel that is formed of a resilient material and that includes a first outer wall, the first outer wall being structured to engage a first side of the at least one toy vehicle 12 of the plurality of toy vehicles 12 for accelerating the vehicle. The at least one drive wheel also includes a second drive wheel that is formed of a resilient material and that includes a second outer wall, the second outer wall being structured to engage a second side of the toy vehicle 12 of the plurality of toy vehicles 12 opposite the first side for accelerating the toy vehicle 12. The booster element 60 also includes a first drive element that is operably connected to the first drive wheel, a second drive element that is operably connected to the second drive wheel, and the drive mechanism that is operably connected to the first drive element and to the second drive element, the drive mechanism being operable to drive the first and second drive elements for rotating the first drive wheel and the second drive wheel in opposite directions.

In an embodiment, the booster mechanism 64 also includes at least one battery that is connected to the drive mechanism to provide power to the drive mechanism, and a control mechanism that is connected to the drive mechanism and/or the at least one battery for controlling the operation of the drive mechanism. In the specific embodiment provided in FIGS. 1 to 4, the control mechanism includes an on/off button that is mounted through the booster housing 63 so as to be accessible to a user of the launching apparatus 10.

In the specific embodiment provided in FIGS. 1 to 4 and 6A to 7, the booster element 60 is the wheel booster, and the at least one drive wheel includes first and second drive wheels (not shown). The first and second drive wheels are disposed on opposing sides of the middle part 30*b* of the launching section 30 of the track segment 20*a* such that each of the first and second drive wheels extend at least partially over the middle part 30*b* of the launching section 30. In this way, the first and second drive wheels can engage opposing lateral sides of the at least one toy vehicle 12 for accelerating the at least one toy vehicle 12 along the launching section 30.

In an embodiment such as shown in FIGS. 1 to 7, the launching apparatus 10 is structured to have an animal-like resemblance. To achieve this animal like resemblance, the launching apparatus 10 includes at least one decorative element 70 that is connected to part of the track body 20 and that is structured so as to resemble a recognizable aspect of the animal that the launching apparatus 10 is supposed to bear resemblance to. The at least one decorative element 70 is connected to at least one of the track segment 20*a*, support base 20*b* and a booster element 60 of the launching apparatus 10.

In the specific embodiment provided in FIGS. 1 to 7, the launching apparatus 10 is structured to resemble a scorpion. The at least one decorative element 70 includes a pair of claw elements 70*a* connected on opposing lateral sides of the track body 20, towards a first free end of the track body 20. The at least one decorative element 70 also includes a plurality of leg elements 70*b* that are connected along the opposing laterals sides and a rear end of the support base 20*b* of the track body 20 so as to resemble the legs of a scorpion. Lastly, the launching apparatus 10 includes a stinger element 70*c* that is connected to a second free end of the track body 20, proximate the inverted support region 22*a* of the holding section 22, and that is structured to resemble the tail-stinger of a scorpion. In this way, the booster element 60 and some of the track body 20 of the launching apparatus 10 resembles the body of the scorpion, and the remainder of the track body 20 resembles the tail of the scorpion.

In an embodiment, the track segment 20*a* of the track body 20 is formed as a partially looped track segment.

In an additional embodiment such as provided in FIGS. 1 to 4 and 6A to 7, the partially looped track segment is formed such that the track segment 20*a* of the track body 20 includes an upper, substantially straight ramp portion 24, a curved ramp portion 26 that extends downwards from the upper, substantially straight ramp portion 24, and a launching ramp portion 28 that extends out from a bottom end of the curved ramp portion 26. The launching ramp portion 28 defines the launching section 30 of the track segment 20*a* and can, in some embodiments, also define part of the holding section 22. Said another way, the holding section 22 of the track segment 20*a* does not have to terminate at the end of the curved ramp portion 26 (rather, the holding section 22 of the track segment 20*a* terminates at a position past the release element 40).

In an additional embodiment, the release element 40 is positioned on the track body 20 such that the holding section 22 is defined along the upper, substantially straight ramp portion 24 and the curved ramp portion 26, and the launching section 30 is defined along the launching ramp portion 28.

Figure 4:
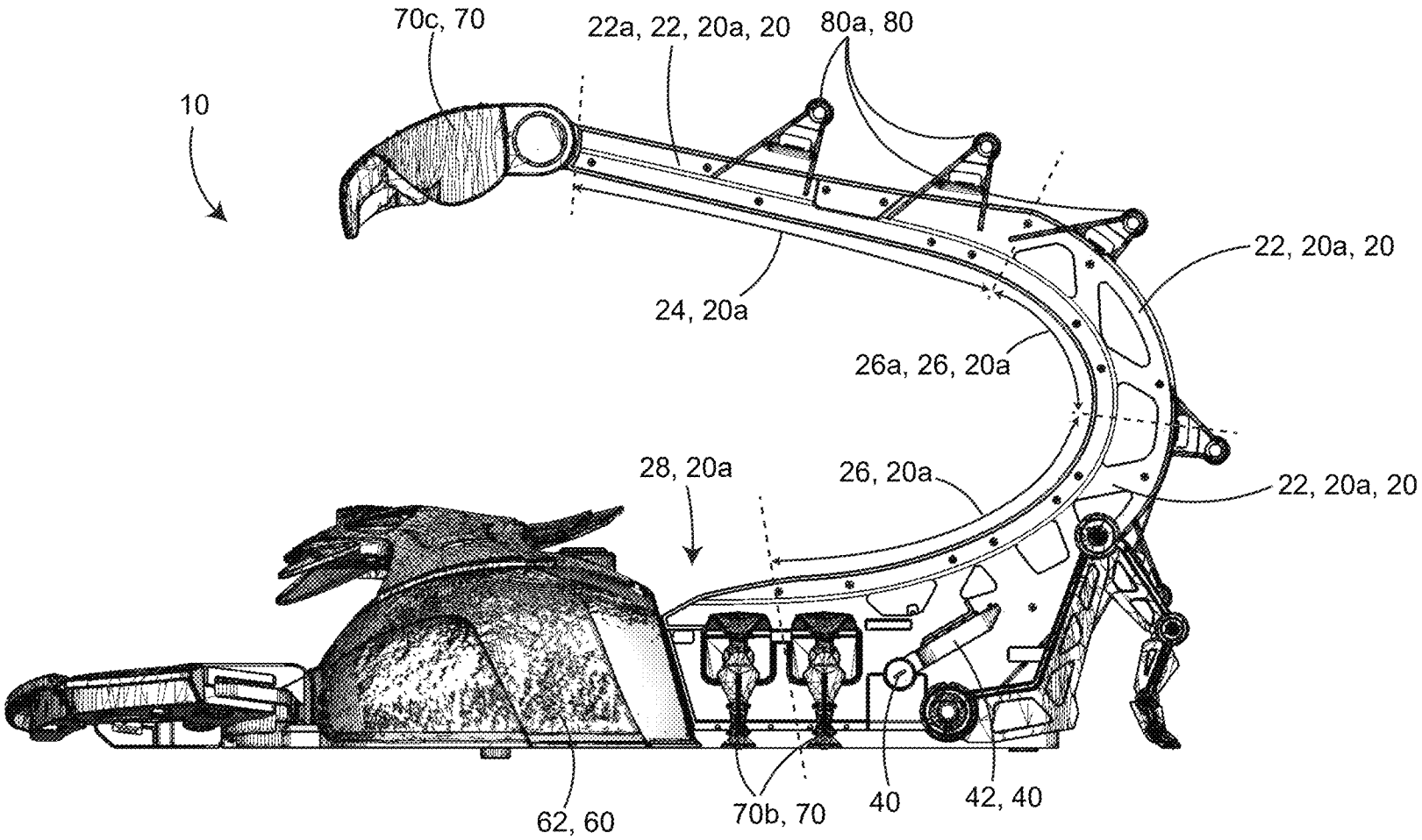
FIG. 4 shows a right-side view of the embodiment of the launching apparatus in FIG. 1.

In the specific embodiments provided in FIGS. 4, the partially looped track segment is structured such that the upper, substantially straight ramp portion 24 includes first and second ends, and extends at an angle relative to the horizontal such that the plurality of toy vehicles 12 will advance along the upper, substantially straight ramp portion 24 under the influence of gravity, as at least one of the plurality of toy vehicles 12 is released onto the launching section 30 by the release element 40. The curved ramp portion 26 includes a first end that is connected to the second end of the upper, substantially straight ramp portion 24, and has a substantially U-shaped curve so that a second end of the curved ramp portion 26 extends in the opposite direction to the first end thereof. The second end of the curved ramp portion is connected to launching ramp portion 28. As described above, the launching ramp portion 28 includes at least the launching section 30 of the track segment 20*a*.

In an additional embodiment, the launching ramp portion 28 of the partially looped track segment defines an end 29 of the track body 20 off which the plurality of toy vehicles 12 are launched.

Figure 2:
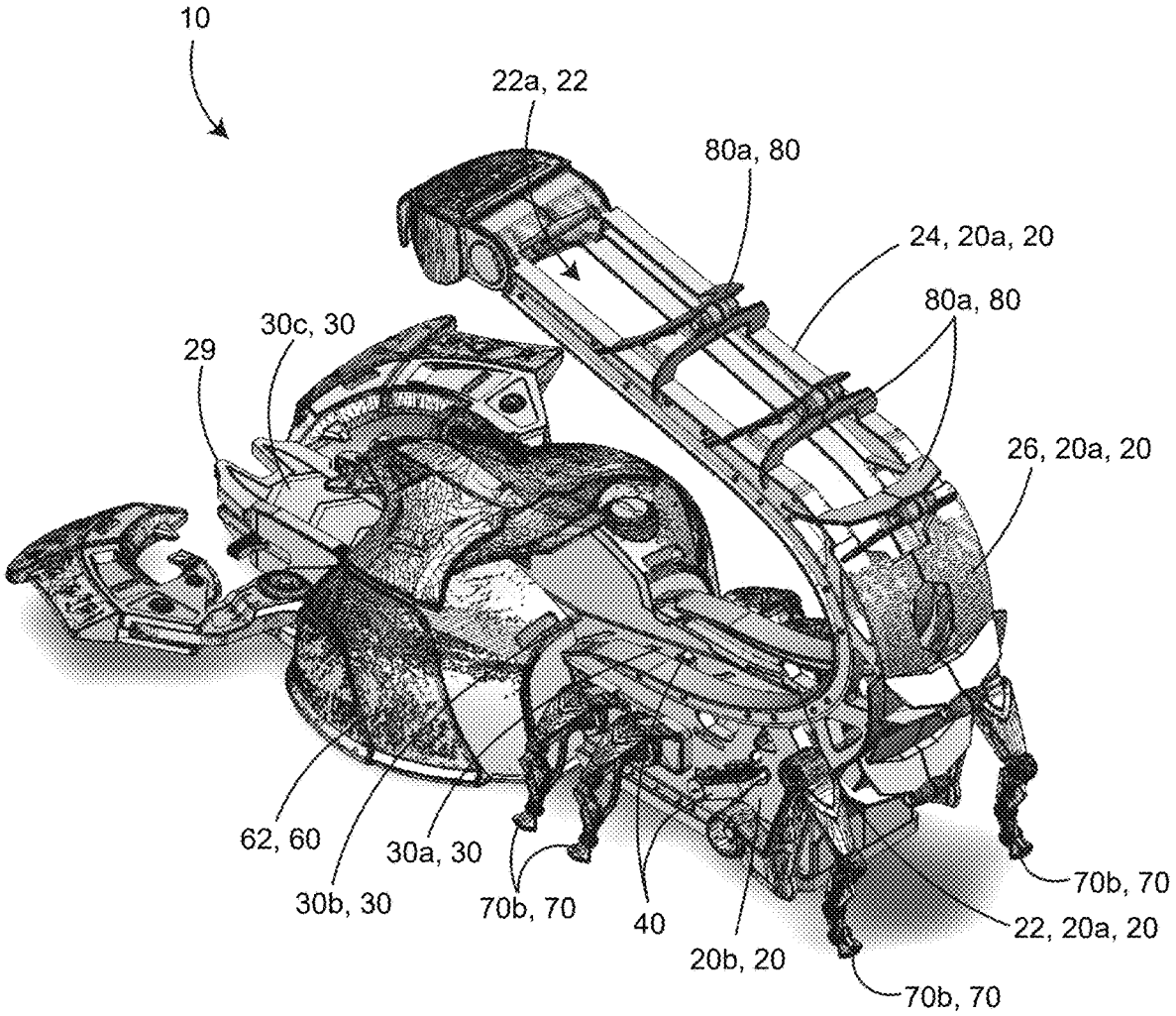
FIG. 2 shows a rear, perspective view of the embodiment of the launching apparatus of FIG. 1.
Figure 3:
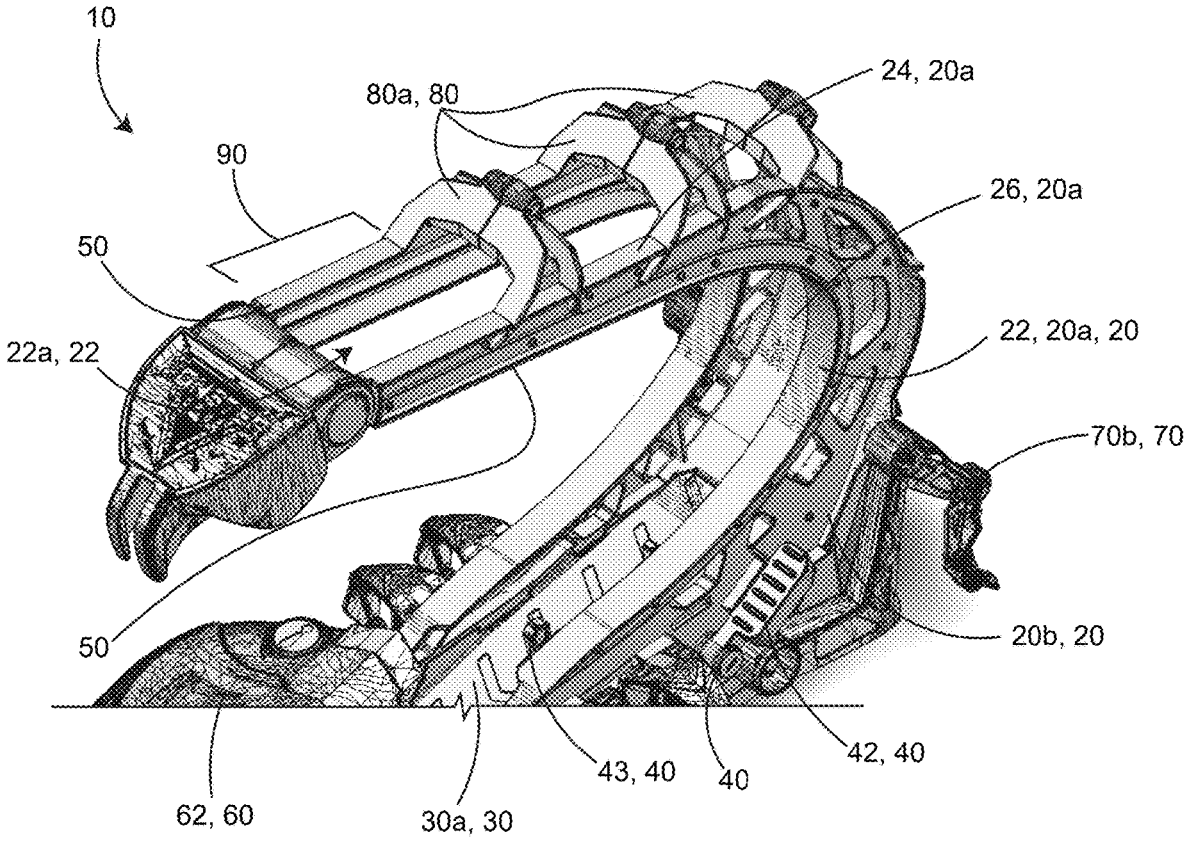
FIG. 3 shows a close-up, perspective view of the holding section of the embodiment of the launching apparatus in FIG. 1.

In the specific embodiment provided in FIGS. 1 to 2 and 4, the end 29 of the track body 20 is defined on the third, distal part 30*c* of the launching section 30. The support base 20*b* of the track body 20 includes a pair of guide walls 21 that are positioned on either side of the third, distal part 30*c* of the launching section 30.

The holding section 22 and launching section 30 of the track body 20 as disclosed herein can be defined by various combinations of the above-described portions of the partially looped track segment.

In an exemplary embodiment such as shown in FIGS. 1 to 4 and 6A to 7, the holding section 22 of the track body 20 is defined by the partially looped track segment portion, and the curved ramp portion 26, while the launching section 30 is defined by the launching ramp portion 28. The curved ramp portion 26 terminates on a first side of the release element 40 and the launching ramp portion 28 begins where the curved ramp portion 26 ends. As noted above, the holding section 22 of the track segment 20*a* does not have to terminate at the end of the curved ramp portion 26.

Figure 6A:
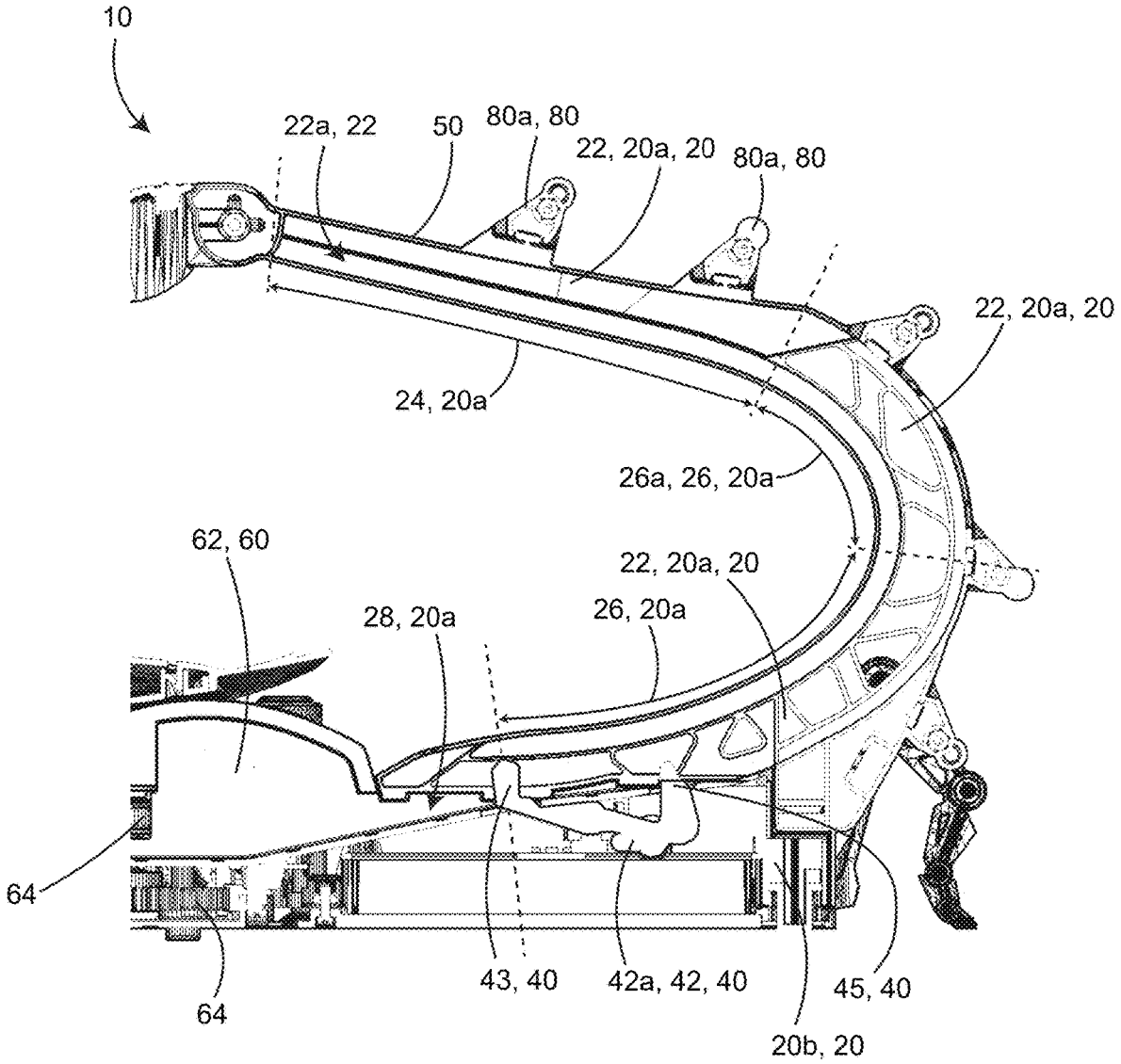
FIG. 6A shows a side, section view of the embodiment of the launching apparatus of FIG. 1, where the release element is in the blocking position.
Figure 6B:
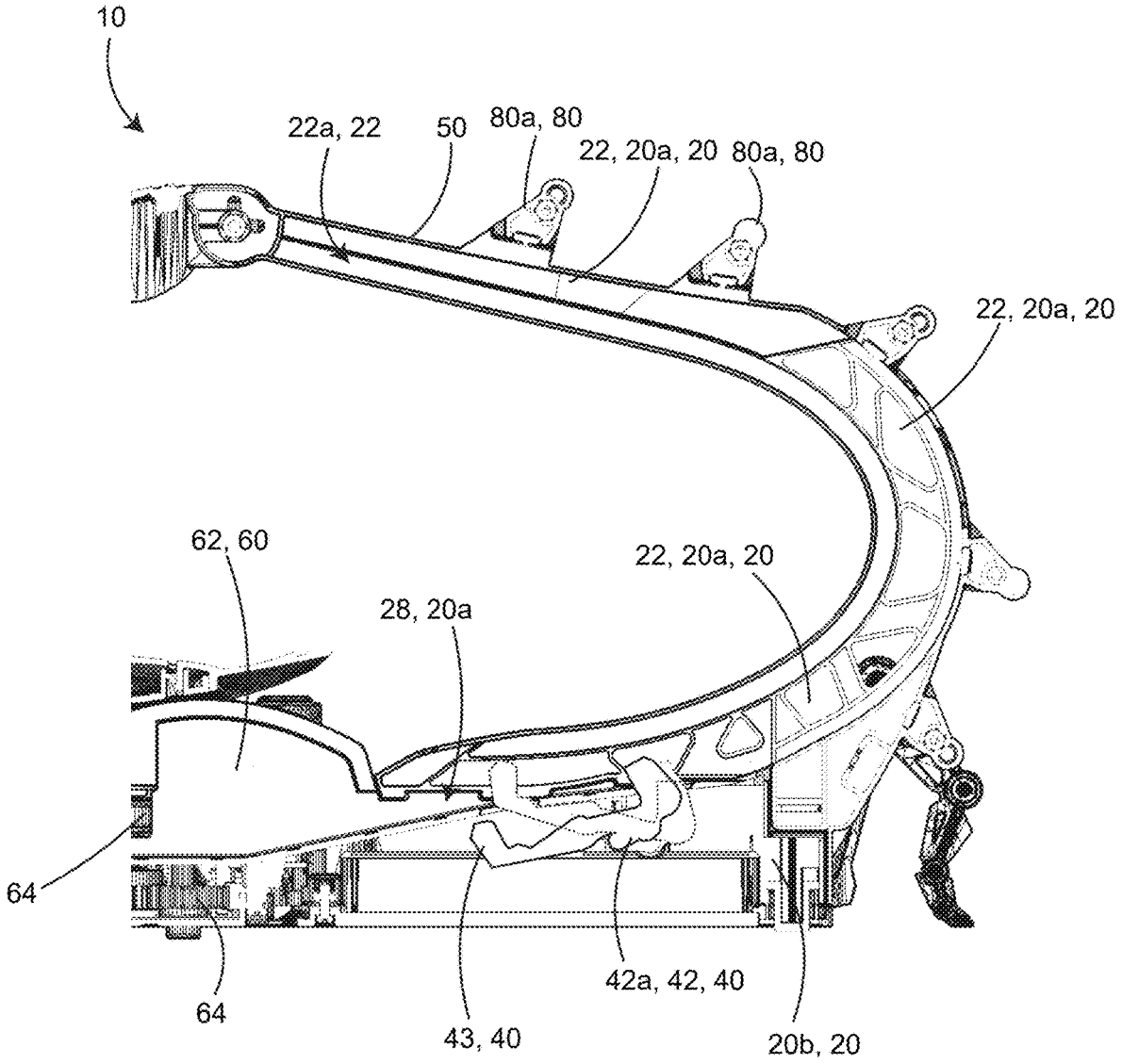
FIG. 6B shows a side, section view of the embodiment of the launching apparatus of FIG. 1, where the release element is in the release position.
Figure 7A:
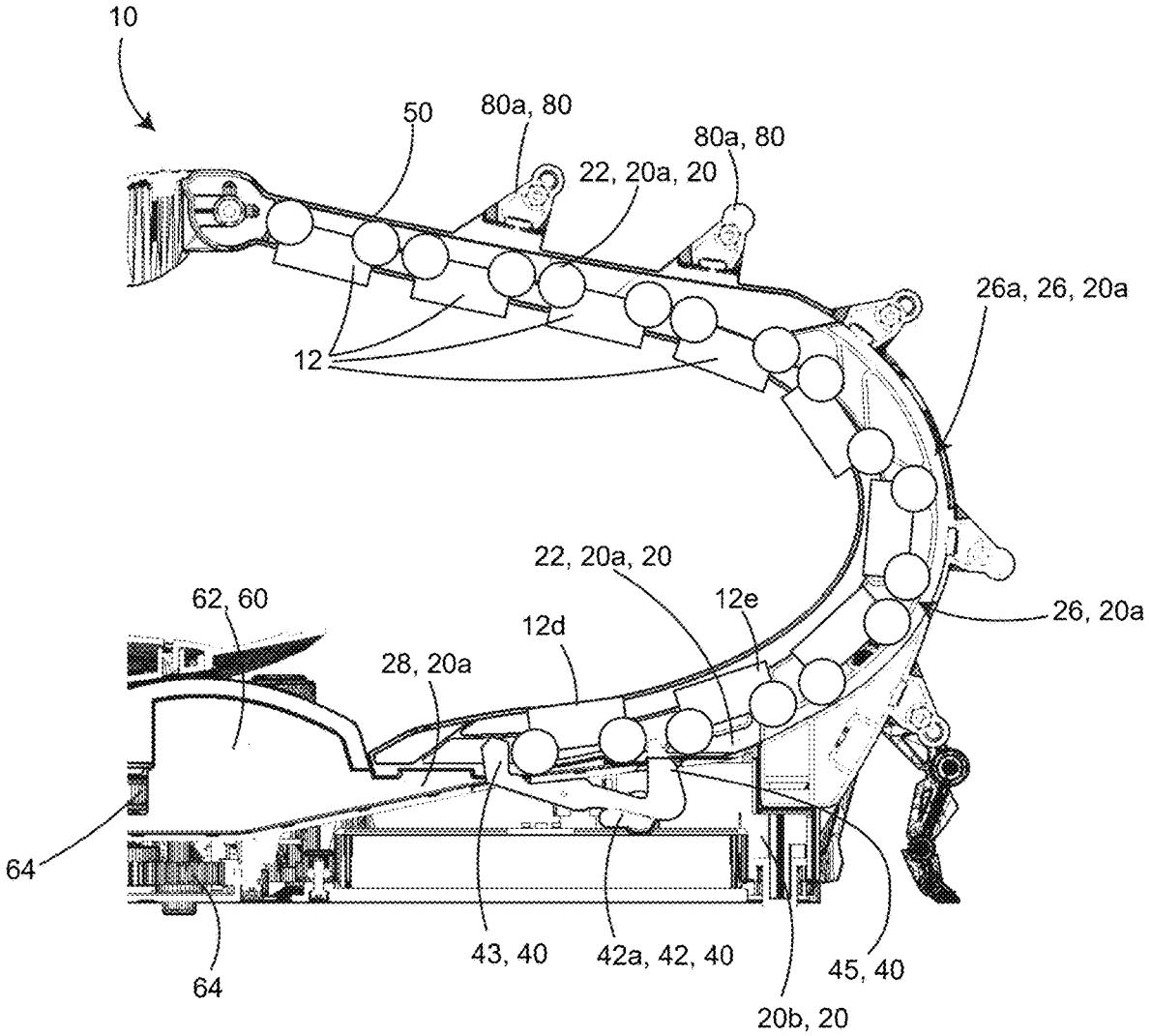
FIG. 7A shows a side, section view of the embodiment of the launching apparatus of FIG. 1, where the plurality of toy vehicles are held in a sequential line along the holding section of the track body and the lever element is in the engaged position.
Figure 7B:
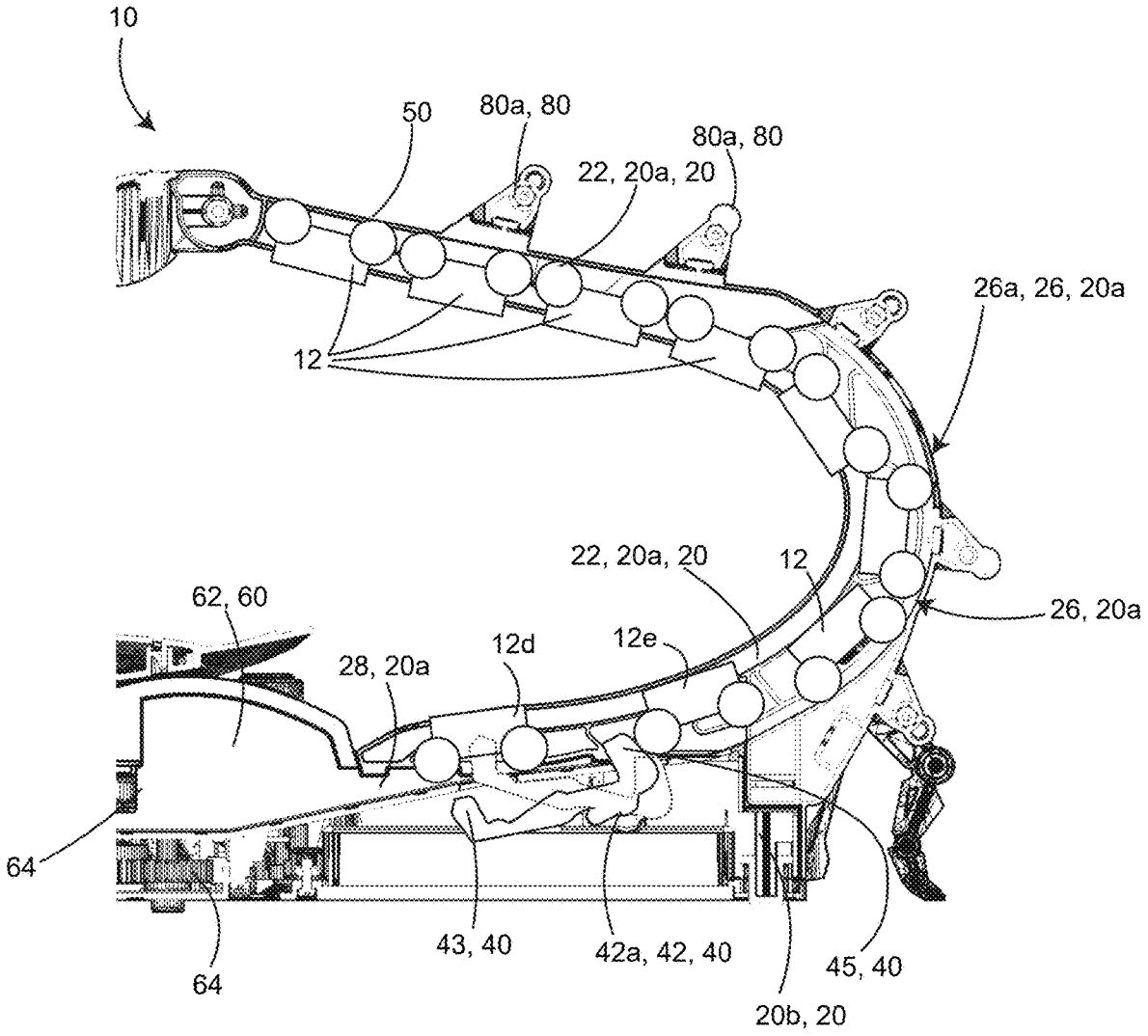
FIG. 7B shows a side, section view of the embodiment of the launching apparatus of FIG. 1, where the plurality of toy vehicles are held in a sequential line along the holding section of the track body and the lever element is in the disengaged position for releasing one of the plurality of toy vehicles onto the launching section.
Figure 7C:
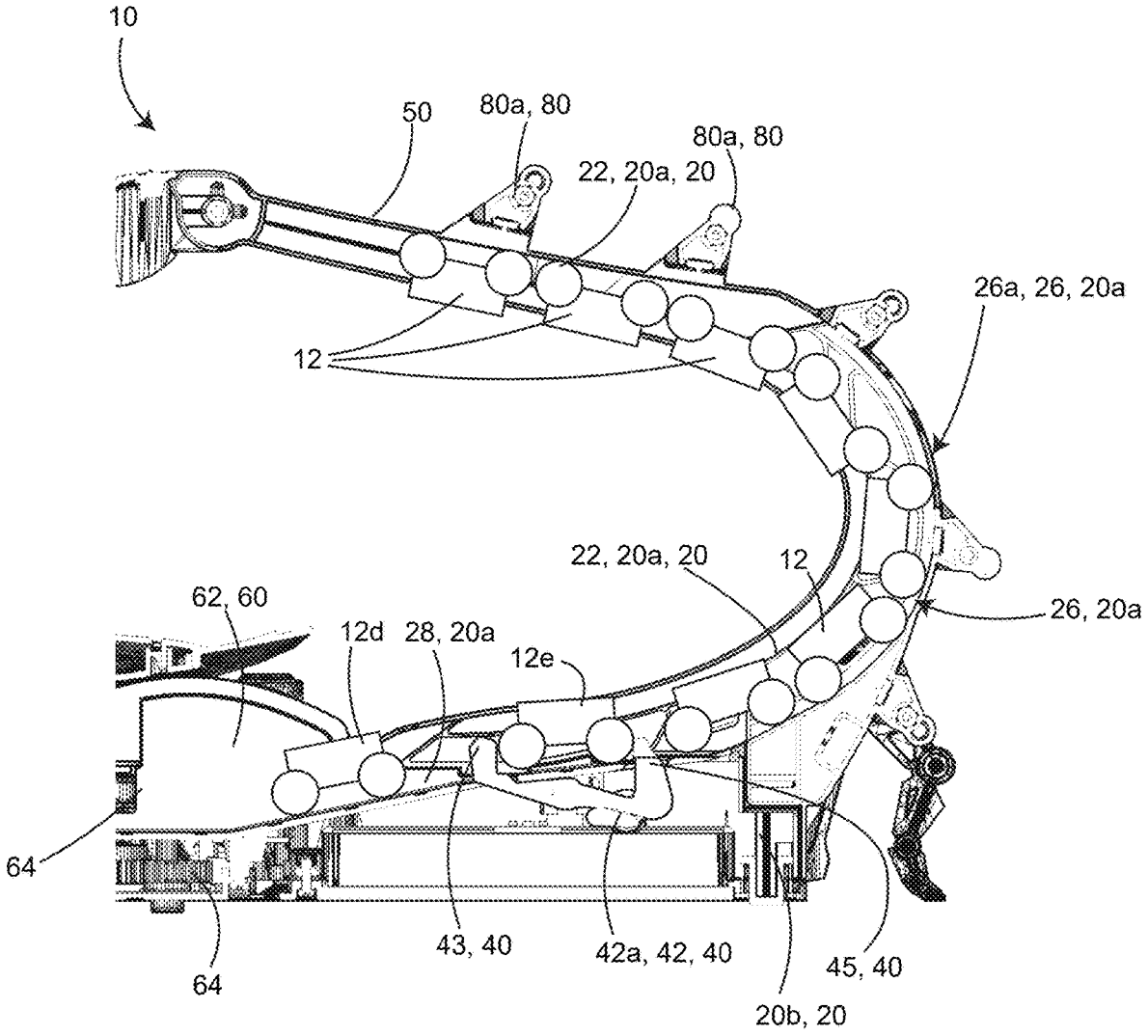
FIG. 7C shows a side, section view of the embodiment of the launching apparatus of FIG. 1, where the plurality of toy vehicles are held in a sequential line along the holding section of the track body and the lever element is again in the engaged position.

In an additional embodiment such as shown in FIGS. 6A to 7, the partially looped track segment of the track body 20 is structured such that the inverted support region 22*a* is defined along the upper, substantially straight ramp portion 24 and a first part 26*a* of the curved ramp portion 26. As shown in FIGS. 7A-7C, the partially looped track segment portion is formed so that in the upper, substantially straight ramp portion 24 and the first part 26*a* of the curved ramp portion 26, any of the plurality of toy vehicles 12 which are held in these regions will be held in the at least partially upside-down orientation.

Figure 5A:
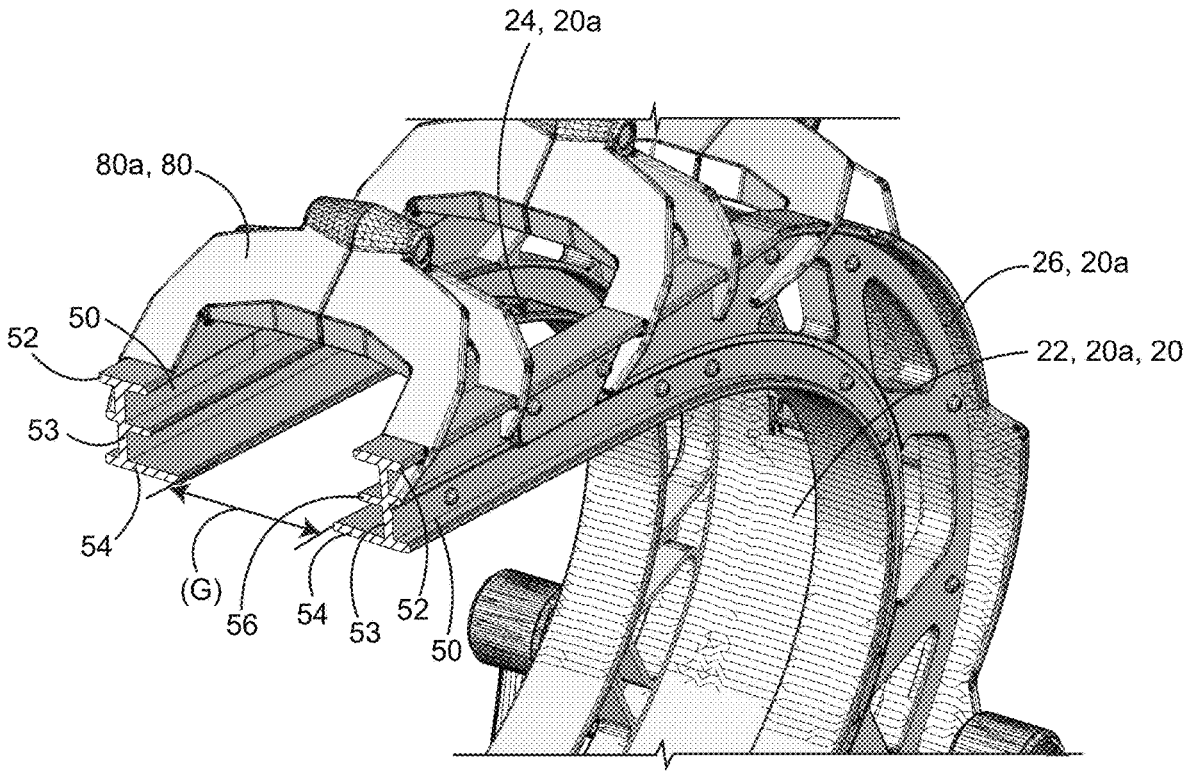
FIG. 5A shows a perspective, section view of a portion of the holding section of the embodiment of the launching apparatus in FIG. 1.
Figure 5B:
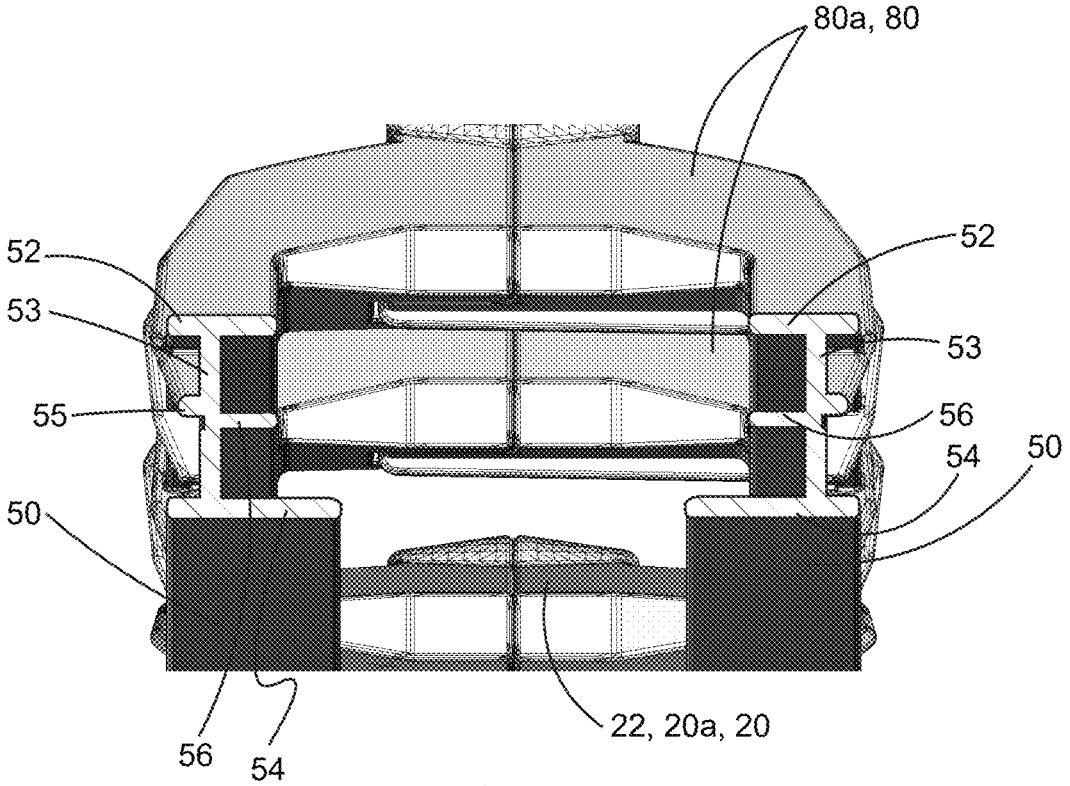
FIG. 5B shows a straight-on, section-view of the portion of the holding section shown in FIG. 5A.
Figure 5C:
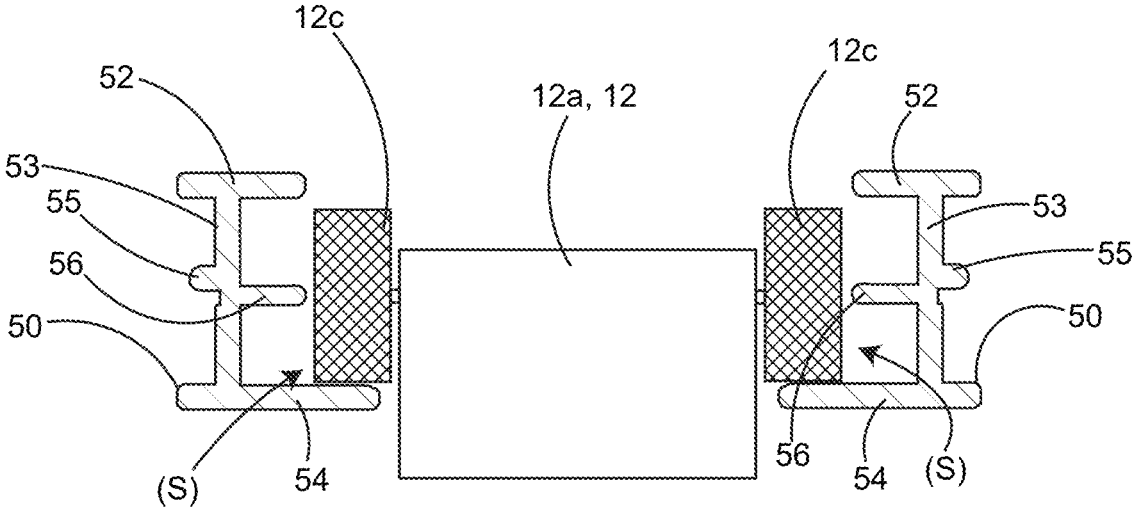
FIG. 5C shows a section-view of the portion of the holding section shown in FIG. 5A, where one of the plurality of toy vehicles is supported in the at least partially upside-down orientation on the holding section.

FIGS. 5A, 5B and 5C set forth section views of a portion of upper, substantially straight ramp portion 24, all of which are taken along the same section line. In FIG. 5C, one of the plurality of toy vehicles 12 is shown in an at least partially upside-down orientation, traversing this same portion of the substantially straight ramp portion 24.

In an embodiment such as shown in FIGS. 1 to 7C, the track body 20 is formed such that at least the inverted support region 22*a* of the track body 20 includes a pair of parallel, supporting track rails 50. The pair of parallel, supporting track rails 50 collectively define at least the inverted support region 22*a* of the track segment 20*a* along which the plurality of toy vehicles 12 will travel. Each of the pair of parallel, supporting track rails 50 are laterally spaced apart from one another to define a gap (G) therebetween. As shown in FIGS. 5B, 5C and 7 each supporting track rail 50 of the pair of supporting track rails 50 defines a support space (S) therewithin. The support space (S) of each supporting track rail 50 is sized to support at least one wheel of each of the plurality of toy vehicles 12 as the plurality of toy vehicles 12 are supported on at least the inverted support region 22*a* of the track body 20. In this way, each toy vehicle 12 of the plurality of toy vehicles 12 can be supported across the two supporting track rails 50.

In the specific embodiment provided in FIG. 5C, the toy vehicle 12 of the plurality of toy vehicles 12 that is shown supported across the two supporting track rails 50 includes a body 12*a* defining a top surface and a bottom surface. The vehicle further includes a pair of front wheels 12*b* (not shown in FIG. 5C) and a pair of rear wheels 12*c* that are positioned on either side of the body 12*a* to support the toy vehicle 12 on a surface. The front and rear wheels 12*b*, 12*c* are positioned on the body 12*a* such that the wheels 12*b*, 12*c* extend down, below the bottom surface of the body 12*a*. By providing the gap (G) between the pair of supporting track rails 50 of the track body 20, the gap (G) readily accommodates the body 12*a* of the toy vehicle that extends downwards relative to the pair of supporting track rails 50 when toy vehicle 12 is in the at least partially upside-down orientation.

In an additional embodiment, each track rail 50 of the pair of supporting track rails 50 including a lower rail surface 54, an upper rail surface 52 and a lateral guide surface 53 extending therebetween. The support space (S) of each track rail 50 of the pair of supporting track rails 50 is defined between the lateral guide surface 53, the lower rail surface 54, and the upper rail surface 52. The supporting track rails 50 are structured so that along the inverted support region 22*a* of the track body 20, the wheels of the plurality of toy vehicles 12 are supported on, and roll along, the lower rail surface 54 of each of the pair of supporting track rails 50.

In the specific embodiment provided in FIGS. 5A to 5C, each track rail 50 of the pair of supporting track rails 50 is structured to include the lower rail surface 54, the upper rail surface 52 and the lateral guide surface 53 extending therebetween. The cross-section of the pair of supporting track rails 50 is shown in FIGS. 5B and 5C. The upper rail surface 52 is a straight flange that is connected to a top end of the lateral guide surface 53 and which extends about either side of the lateral guide surface 53. Similarly, the bottom flange is a straight flange that is connected to a bottom end of the lateral guide surface 53 and which extends about either side of the lateral guide surface 53. Each supporting track rail 50 also includes an exterior supporting rib 55 and an interior supporting rib 56 that is disposed on the lateral guide surface 53 between the upper and lower flanges 52, 54 so as to ensure the wheels of each of the plurality of toy vehicles 12 remain suitably centered across the pair of supporting track rails 50.

In the specific embodiment shown in FIGS. 1 to 5A and 6A to 7, the upper, substantially straight ramp portion 24 of the partially looped track segment and the first part of the curved ramp portion 26 are formed from the pair of parallel, supporting track rails 50. In the curving of the track body 20 to form the curved ramp portion 26, the upper and lower flanges 52, 54 of each of the parallel, supporting track rails 50 diverge apart and the height of the lateral guide surface 53 of each of the parallel, supporting track rails 50 increases. In the first part of the curved ramp portion 26, the lateral guide surface 53 of each of the pair of parallel, supporting track rails 50 is formed as a trussed structured to reduce the weight of the lateral guide surface 53 while maintaining structural stability of the track body 20.

In an additional embodiment, the track body 20 of the launching apparatus 10 further includes at least one blocking element 80. The at least one blocking element 80 is positioned along at least the inverted support region 22*a* of the track body 20 and is structured so as to prevent the plurality of toy vehicles 12 from travelling along the inverted support region 22*a* in an at least partially right-side up orientation.

In the specific embodiment provided in FIGS. 1 to 7, the at least one blocking element 80 is a plurality of arched blocking elements 80*a* that are positioned along the inverted support region 22*a* and the first part 26*a* of the curved ramp portion 26 of the track segment 20*a*. Each arched blocking element 80*a* of the plurality of arched blocking elements 80*a* is mounted on top of the pair of supporting track rails 50 and extends between the pair of supporting track rails 50 such that the blocking element spans the gap (G) in between the track rails 50. In this embodiment, each toy vehicle 12 of the plurality of toy vehicles 12 is sized such that if the vehicle 12 were to travel along the inverted supported region 22*a* in a right-side up orientation, at least the upper surface of the body 12*a* of the vehicle 12 would extend above the upper rail surface 52 of each of the pair of supporting track rails 50. Because each of the arched blocking elements 80*a* spans the gap between the pair of supporting track rails 50 and is positioned on top of the pair of supporting track rails 50, the body 12*a* of the vehicle 12 would abut against at least one of the plurality of arched blocking elements 80*a* as the vehicle travels along the inverted supported region in this at least partially right-side up orientation. In this way, the plurality of arched blocking elements 80*a* prevent the plurality of toy vehicles 12 from travelling along the inverted support region 22*a* in the right-side up orientation.

In an additional embodiment such as shown in FIGS. 1 to 7, the track segment 20*a* of the track body 20 is formed such that the holding section 22 of the track body 20 includes a loading portion 90 that is structured for loading at least one of the plurality of toy vehicles 12 into the holding section 22. The loading portion 90 of the holding section 22 is structured such that the at least one vehicle 12 of the plurality of toy vehicles 12 can be loaded through the loading portion 90 and into the holding section 22 while in the at least partially upside-down orientation.

In an additional embodiment, the loading portion 90 is defined between the pair of supporting track rails 50 of the track body. In this embodiment, the pair of supporting track rails 50 are structured such that the lower rail surface 54 of each supporting track rail 50 extends further inward than the upper rail surface 52 of each supporting track rail 50. Because the upper rail surface 52 does not extends as far inward, at least one of the plurality of toy vehicles 12 can be loaded into the loading portion 90 by inserting the at least one toy vehicle 12 through the gap between the upper flanges 52 of the pair of supporting track rails 50 (while the at least one toy vehicle 12 is in the at least partially upside-down orientation) until the wheels 12*b*, 12*c* of the vehicle 12 are supported on the lower flanges 54 of the pair of supporting track rails 50.

In the specific embodiment provided in FIGS. 1 to 7, the loading portion 90 of the holding section 22 is defined by a length of the inverted support region 22*a* that extends between the second free end of the track body 20, and a first of the plurality of arched blocking elements 80*a*. Along this length of the inverted support region 22*a*, there are no structures which impede the loading of at least one of the plurality of toy vehicles 12 into the inverted support region 22*a*. As show in FIGS. 5B and 5C, the pair of supporting track rails 50 are structured such that the lower rail surface 54 of each supporting track rail 50 extends further inward than the upper rail surface 52 of each supporting track rail 50. Because the upper rail surface 52 does not extends as far inward, at least one of the plurality of toy vehicles 12 can be loaded into the loading portion 90 by inserting the at least one toy vehicle 12 through the gap between the upper flanges 52 of the pair of supporting track rails 50 (while the at least one toy vehicle 12 is in the at least partially upside-down orientation) until the wheels 12*b*, 12*c* of the vehicle 12 are supported on the lower flanges 54 of the pair of supporting track rails 50.

As provided above, the release element 40 of the launching apparatus 10 is movable between the blocking position (shown in FIGS. 6A and 7) and the release position (shown in FIG. 6B) for selectively releasing at least one toy vehicle 12 of the plurality of toy vehicles 12 from the holding section 22 onto the launching section 30.

In an embodiment, the positioning of the release element 40 on the track body 20 defines the intersection of the holding section 22 and the launching section 30 of the track body 20. For example, as shown in FIGS. 6A and 6B, the release element 40 can be positioned on the track body 20 such that the holding section 22 is defined along the upper, substantially straight ramp portion 24 and the curved ramp portion 26, and the launching section 30 is defined along the launching ramp portion 28.

In an additional embodiment, the release element 40 is biased towards the blocking position.

In some embodiments of the launching apparatus 10, the at least one toy vehicle 12 of the plurality of toy vehicles 12 is released from the holding section 22 onto the launching section 30 under the influence of gravity. When the release element 40 is in the blocking position, it prevents the movement of the at least one toy vehicle 12 under the influence of gravity.

In an additional embodiment, the release element 40 further includes a lever element 42 that is rotatably mounted to the track body 20 for rotating between an engaged position corresponding to the blocking position of the release element 40 (see FIGS. 6A, 7A and 7C), and a disengaged position corresponding to the launching position of the release element 40 (see FIGS. 6B and 7B). The release element 40 also includes a first stopper element 43 that is structured to engage a first toy vehicle 12*d* of the plurality of toy vehicles 12 (i.e., a bottommost toy vehicle 12 of the plurality of toy vehicles 12 in the sequential line of toy vehicles 12). The first stopper element 43 is connected to the lever element 42 of the release element 40 and is structured to engage the first toy vehicle 12, when the lever element 42 is in the engaged position, for substantially maintaining the first toy vehicle 12 in place along the holding section 22 (i.e., preventing the first toy vehicle 12*d* from being released onto the launching section 30).

In an additional embodiment, the first stopper element 43 is operably connected to the lever element 42 such that the first stopper element 43 will rotate with the lever element 42 as the lever element 42 is driven between the engaged and disengaged positions.

In some embodiments, the release element 40 of the launching apparatus 10 is biased towards the blocking position. In an embodiment where the release element 40 includes the lever element 42 and first stopper element 43, the release element 40 further includes a biasing element (not shown) that is connected between the support base 20*b* and at least one of the lever element 42 and the first stopper element 43 for biasing the lever element 42 towards the engaged position.

As shown in FIG. 7A, when the lever element 42 is in the engaged position, the first stopper element 43 is positioned along the holding section 22 to substantially maintain the first toy vehicle 12 in place along the holding section 22. When the lever element 42 is driven towards the disengaged position (as shown in FIGS. 7B), the first stopper element 43 is driven down, below the holding section 22 of the track body 20, such that the first stopper element 43 is not disposed along the track body 20 and no longer impedes the movement of the first toy vehicle 12*d* along the track body 20. The first toy vehicle 12*d* is therefore free to travel from the holding section 22 onto the launching section 30 under the influence of gravity. As shown in FIG. 7C, once the first toy vehicle 12*d* has been release onto the launching section 30 of the track body 20, the lever element 42 (i.e., release element 40) is driven back towards the engaged position by the biasing element and moves back into the engaged position to thereby prevent a second vehicle 12*e* of the plurality of toy vehicles 12 from moving onto the launching section 30 from the holding section 22.

In some embodiments, the first stopper element 43 is disposed on a forward portion of the lever element 42 such that the first toy vehicle 12*d* sits above the release element 40 and is held in place above the release element 40 and on the holding section 22 of the track body 20, when the lever element 42 is in the engaged position. It will be readily understood that any toy vehicle 12 of the plurality of toy vehicles 12 can be held in place by the first stopper element 43 in the position above the release element 40 when the lever element 43 is in the engaged position, depending on how many of the toy vehicles 12 have already been launched from the launching apparatus 10.

In the specific embodiment provided in FIGS. 1 to 7C, the lever element 42 is structured as an elongated lever arm 42*a* that is pivotably connected to the support base 20*b* of the track body 20. The lever arm 42*a* is pivotably connected to the support base 20*b* proximate a midpoint of the elongated lever arm 42*a*. The first stopper element 43 of the release element 40 is integrally formed with the elongated lever arm 42*a*, on one end of the lever arm 42*a* and extends outward from the rest of the elongated lever arm 42*a*. As shown in FIG. 7A, when the lever element 42 is in the engaged position, afront end of the first toy vehicle 12*d* of the plurality of toy vehicles 12 will abut the first stopper element 43 such that the plurality of toy vehicles 12 are held in place in a sequential line.

In an additional embodiment, at least a portion of the holding section 22 of the track segment 20*a* (i.e., the curved ramp portion 26 of the holding section 22) includes a pass-through aperture. The pass-through aperture is sized and positioned such that as the lever element 42 pivots between the engaged and disengaged positions, at least the first stopper element 43 on the elongated lever arm 42*a* will pass through the pass-through aperture. In this way, when the lever element 42 is in the engaged position, the first stopper element 43 will project at least partially above an upper surface of the holding section 22 of the track segment 20*a* such that the first stopper element 43 can contact the first toy vehicle 12*d* of the plurality of toy vehicles 12 held in the holding section 22.

In an additional embodiment such as shown in FIGS. 6A to 7C, the release element 40 includes a second stopper element 45. The second stopper element 45 is connected to the lever element 42 away from the first stopper element 43, and the second stopper element 45 is structured to engage a second toy vehicle 12*e* of the plurality of toy vehicles 12 that is held behind the first toy vehicle 12*d*, when the lever element 42 is in the disengaged position, for impeding the second toy vehicle 12*e* as the first toy vehicle 12*d* is released from the holding section 22 onto the launching section 30.

In an embodiment, the second stopper element 45 is formed on a portion of the lever element 42 that is more rearward than the forward portion of the lever element 42 on which the first stopper element 43 is disposed. The second stopper element 45 functions to control the movement of the second toy vehicle 12*e* of the plurality of toy vehicles 12 while the first toy vehicle 12*d* is being released onto the launching section 30 due to the movement of the lever element 42. In this way, the second stopper element 45 will substantially hold the second toy vehicle 12*e* in place on the holding section 22 of the track body 20 when the first toy vehicle 12*d* is released from the holding section 22 by the movement of the release element 40. As shown in FIG. 7B, when the lever element 42 has been pivoted into the disengaged position for releasing the first toy vehicle 12*d* onto the launching section 30, the first stopper element 43 is disposed below the holding section 22 of the track body 20 and the second stopper element 45 extends at least partially above the holding section 22 into a position along the track body 20. The second stopper element 45 is in a position where the second stopper element 45 can contact a forward portion of the second toy vehicle 12*e* and thereby substantially maintain the position of the second toy vehicle 12*e* along the holding section 22. When the lever element 42 is pivoted back into the engaged position (as shown in FIG. 7C), the second stopper element 45 will again be disposed below the holding section 22 such that the second stopper element 45 no longer impedes the movement of the second toy vehicle 12*e* along the holding section 22. In this way, the second toy vehicle 12*e* is able to advance along the holding section 22 until the second toy vehicle 12*e* contacts the first stopper element 43 of the lever element 42. The second toy vehicle 12*e* can then be released onto the launching section 30 of the track body 20 via another movement of the lever element 42 towards the disengaged position.

In the specific embodiment provided in FIGS. 1 to 7, the lever element 42 is structured as the elongated lever arm 42*a* that is pivotably connected to the support base 20*b* of the track body 20. The second stopper element 45 on the lever element 42 is integrally formed with the elongated lever arm 42*a*, on an end of the lever arm 42*a* that is opposite the first stopper element 43. The second stopper element 45 extends outward from the rest of the elongated lever arm 42*a*.

In an additional embodiment, at least a portion of the holding section 22 of the track segment 20*a* (i.e., the curved ramp portion 26 of the holding section 22) includes an additional pass-through aperture. This additional pass-through aperture is sized and positioned such that as the lever element 42 pivots between the engaged and disengaged positions, at least the second stopper element 45 on the elongated lever arm 42*a* will pass through the additional pass-through aperture. In this way, when the lever element 42 is in the disengaged position, the second stopper element 45 will project at least partially above an upper surface of the holding section 22 of the track body 20 such that the second stopper element 45 can contact the second toy vehicle 12*e* of the plurality of toy vehicles 12 held in the holding section 22.

In some other embodiments of the launching apparatus 10, the at least one toy vehicle 12 of the plurality of toy vehicles 12 is released from the holding section 22 onto the launching section 30 by part of the release element 40 striking the at least one toy vehicle 12 (while the at least one toy vehicle 12 is on the holding section 22) to thereby drive the at least one toy vehicle 12 onto the launching section 30.

In an additional embodiment, the release element 40 further includes a striking element, and the release element 40 is structured such that as the release element 40 is driven from the blocking position to the launching position, the striking element of the release element 40 will contact the toy vehicle of the plurality of toy vehicles 12 for launching the toy vehicle from the holding section 22, along the launching section 30 of the track body 20.

In an embodiment of the present disclosure, the launching apparatus 10 is provided as part of a toy track set and toy vehicle kit. The toy track set and toy vehicle kit includes a plurality of toy vehicles 12 and the launching apparatus 10 as disclosed herein. The launching apparatus 10 including the track body 20 as disclosed herein, where the track body 20 includes the inverted support region 22*a* that is structured to support the plurality of toy vehicles 12 in an at least partially upside-down orientation, and the launching section 30 that is connected to the inverted support region 22*a*. The launching apparatus 10 also includes the release element 40 that is movable between the blocking position where the release element 40 retains the plurality of toy vehicles 12 on the inverted support region 22*a*, and the launching position where the release element 40 permits the toy vehicle of the plurality of toy vehicles 12 to be released from the inverted support region 22*a* onto the launching section 30. Again, the launching section 30 is oriented relative to the inverted support region 22*a* such that the toy vehicle of the plurality of toy vehicles 12 which is released from the inverted support region 22*a* will travel onto the launching section 30 under the influence of gravity.

In an embodiment such as shown in FIG. 7A, the launching apparatus 10 is structured so that the holding section 22*s* and launching section 30 of the track body 20 hold each toy vehicle of the plurality of toy vehicles 12 in different orientations (relative to a vertical axis of the launching apparatus 10) as each toy vehicle 12 travels along the holding section 22 and launching section 30. In this embodiment, the inverted support region 22*a* of the holding section 22 is structured to hold at least some of the plurality of toy vehicles 12 in an at least partially upside-down, first orientation. The launching section 30 is structured such that the at least one toy vehicle 12 that is released onto the launching section 30 by the release element 40 is held in a second orientation, when the at least one toy vehicle 12 is released onto the launching section 30. The second orientation is defined as a less upside-down orientation than the at least partially upside-down, first orientation.

In an additional embodiment, the second orientation of the at least one toy vehicle 12 on the launching section 30 is an at least partially right-side up orientation.

In an embodiment, the launching apparatus 10 as disclosed herein is integrated as part of a larger toy track set system. The toy track set system includes at least one length of track that is constructed to provided other modes of play for the plurality of toy vehicles 12. In this embodiment, the launching apparatus 10 is used to energize the plurality of toy vehicles 12 and to "launch" the plurality of toy vehicles 12 on to the toy track set system. The launching apparatus 10 can remain separate from the toy track set system or can be releasably or fixedly connected to the toy track set system. The launching apparatus 10 is positioned relative to the toy track set system so that the plurality of toy vehicles 12 can travel along the launching section 30 of the launching apparatus 10 and onto the at least one length of track of the toy track set system. The launching section 30 can be positioned (and possibly connected) to the at least one length of track so as to form an effectively continuous length of track, or the launching section 30 can be spaced apart from the at least one length of track such that when the plurality of toy vehicle travel along and off the launching section 30, the plurality of toy vehicles 12 effectively "jump" from the launching section 30 onto the at least one length of track.

The specific embodiments described above have been shown by way of example, and it should be understood that these embodiments may be susceptible to various modifications and alternative forms. It should be further understood that the above-described embodiments are intended to be examples of the present disclosure and alterations and modifications may be affected thereto, by those of skill in the art, without departing from the scope of the disclosure that is defined solely by the claims appended hereto.

REFERENCE NUMERALS

10 launching apparatus
12 toy vehicles
12*a* body
12*b* pair of front wheels
12*c* pair of rear wheels
12*d* first toy vehicle
12*e* second toy vehicle
20 track body

20*a* track segment
20*b* support base
21 guide walls
22 holding section
22*a* inverted support region
24 upper, substantially straight ramp portion
26 curved ramp portion
26*a* first part of curbed ramp portion
28 launching ramp portion
29 end of the track body
30 launching section
30*a* first, proximal part
30*b* second middle part
30*c* third, distal part
40 release element
42 lever element
42*a* elongated lever arm
43 first stopper element
45 second stopper element
50 supporting track rail
52 upper rail surface
53 lateral guide surface
54 lower rail surface
55 exterior supporting rib
56 interior supporting rib
60 booster element
62 booster housing
64 booster mechanism
70 decorative element
70*a* pair of claw elements
70*b* leg elements
70*c* stinger element
80 blocking element
80*a* arched blocking element
90 loading portion

What is claimed is:

1. A launching apparatus for sequentially launching a plurality of toy vehicles, the launching apparatus comprising:

a track body that includes:

a holding section that is structured to support the plurality of toy vehicles in a sequential line, at least part of the holding section being formed as an inverted support region that is structured to hold at least some of the plurality of vehicles in an at least partially upside-down orientation; and a launching section that is connected to the holding section; and a release element that is movably connected to the track body for moving between a blocking position where the release element retains the plurality of toy vehicles on the holding section, and a launching position where the release element permits at least a first toy vehicle of the plurality of toy vehicles to be released onto the launching section from the holding section;

wherein the launching section is oriented relative to the holding section such that the at least a first toy vehicle of the plurality of toy vehicles is released from the holding section onto the launching section under the influence of gravity.

2. The launching apparatus of claim 1, further comprising:

a booster element that is disposed along a portion of the launching section, wherein the booster element is structured to engage the first toy vehicle of the plurality of toy vehicles that is released from the holding section for accelerating the toy vehicle along the launching section.

3. The launching apparatus of claim 1, wherein the release element further includes:

a lever element that is rotatably mounted to the track body for rotating between an engaged position corresponding to the blocking position of the release element, and a disengaged position corresponding to the launching position of the release element; and a first stopper element that is structured to engage the first toy vehicle of the plurality of toy vehicles when the lever element is in the engaged position.

4. The launching apparatus of claim 3, wherein the first stopper element is operably connected to the lever element such that the first stopper element will rotate with the lever element as the lever element is driven between the engaged and disengaged positions.

5. The launching apparatus of claim 4, wherein the release element further includes a second stopper element that is connected to the lever element away from the first stopper element; and wherein the second stopper element is structured to engage a second toy vehicle of the plurality of toy vehicles that is held behind the first toy vehicle when the lever element is in the disengaged position for impeding the second toy vehicle as the first toy vehicle is released from the holding section onto the launching section.

6. The launching apparatus of claim 5, wherein the release element further includes a biasing element that is connected between the base unit and at least one of the lever element and the stopper element for biasing the lever element towards the engaged position.

7. The launching apparatus of claim 1, wherein at least the inverted support region of the track body is structured to include a pair of parallel, supporting track rails;

wherein the pair of supporting track rails are laterally spaced apart from one another.

8. The launching apparatus of claim 7, wherein each supporting track rail of the pair of supporting track rails defines a support space therewithin; and wherein the support space of each supporting track rail is sized to at least partially support at least one wheel of each of the plurality of toy vehicles as the plurality of toy vehicles are supported on the track body.

9. The launching apparatus of claim 8, wherein each track rail of the pair of supporting track rails includes a lower rail surface, an upper rail surface, and a lateral guide surface; and wherein the support space of each track rail of the pair of supporting track rails is defined between the lateral guide surface, the lower rail surface, and the upper rail surface.

10. The launching apparatus of claim 1, wherein the track body further includes at least one blocking element; and wherein the at least one blocking element is positioned along the inverted support region and is structured so as to prevent the plurality of toy vehicles from travelling along the inverted support region in a right-side up orientation.

11. The launching apparatus of claim 1, wherein the holding section of the track body includes a loading portion that is structured for loading at least one of the plurality of toy vehicles into the holding section; and wherein the loading portion is structured such that the at least one of the plurality of toy vehicles can be loaded through the loading region and into the holding section while in the at least partially upside-down, first orientation.

12. A toy track set and toy vehicle kit, comprising:

a plurality of toy vehicles; and a launching apparatus including:

a track body that includes:

an inverted support region that is structured to support the plurality of toy vehicles in an at least partially upside-down orientation; and a launching section that is connected to the inverted support region;

a release element that is movable between a blocking position where the release element retains the plurality of toy vehicles on the inverted support region, and a launching position where the release element permits at least a first toy vehicle of the plurality of toy vehicles to be released from the inverted support region onto the launching section; and wherein the launching section is oriented relative to the inverted support region such that the at least a first toy vehicle of the plurality of toy vehicles which is released from the inverted support region travels onto the launching section under the influence of gravity.

13. The toy track set and toy vehicle kit of claim 12, further comprising:

a booster element that is disposed along a portion of the launching section, wherein the booster element is structured to engage the first toy vehicle of the plurality of toy vehicles that is released from the holding section for accelerating the toy vehicle along the launching section.

14. The toy track set and toy vehicle kit of claim 12, wherein the release element further includes:

a lever element that is rotatably mounted to the track body for rotating between an engaged position corresponding to the blocking position of the release element, and a disengaged position corresponding to the launching position of the release element; and a first stopper element that is structured to engage the first toy vehicle of the plurality of toy vehicles when the lever element is in the engaged position.

15. The toy track set and toy vehicle kit of claim 14, wherein the first stopper element is operably connected to the lever element such that the first stopper element will rotate with the lever element as the lever element is driven between the engaged and disengaged positions.

16. The toy track set and toy vehicle kit of claim 15, wherein the release element further includes a second stopper element that is connected to the lever element away from the first stopper element; and wherein the second stopper element is structured to engage a second toy vehicle of the plurality of toy vehicles that is held behind the first toy vehicle when the lever element is in the disengaged position for impeding the second toy vehicle as the first toy vehicle is released from the holding section onto the launching section.

17. The toy track set and toy vehicle kit of claim 12, wherein at least the inverted support region of the track body is structured to include a pair of parallel, supporting track rails;

wherein the pair of supporting track rails are laterally spaced apart from one another.

18. The toy track set and toy vehicle kit of claim 17, wherein each supporting track rail of the pair of supporting track rails defines a support space therewithin; and wherein the support space of each supporting track rail is sized to at least partially support at least one wheel of each of the plurality of toy vehicles as the plurality of toy vehicles are supported on the track body.

19. A launching apparatus for sequentially launching a plurality of toy vehicles, the launching apparatus comprising:

a track body that includes:

a holding section that is structured to support the plurality of toy vehicles in a sequential line, at least part of the holding section being formed as an inverted support region that is structured to hold at least some of the plurality of vehicles in an at least partially upside-down, first orientation; and a launching section that is connected to the holding section; and a release element that is movably connected to the track body for moving between a blocking position where the release element retains the plurality of toy vehicles on the holding section, and a launching position where the release element permits at least one toy vehicle of the plurality of toy vehicles to be released onto the launching section from the holding section under the influence of gravity;

wherein the launching section is structured such that the at least one toy vehicle is held in a second orientation when the at least one toy vehicle is released onto the launching section; and wherein the second orientation is less upside-down than the at least partially upside-down, first orientation.

20. The launching apparatus of claim 19, wherein the second orientation is an at least partially upright orientation.

* * * * *